United States Patent [19]

Guild et al.

[11] 4,057,970

[45] Nov. 15, 1977

[54] ROTARY FLUID SUPPLY JOINTS FOR EXPANSIBLE MANDRELS

[76] Inventors: Charles L. Guild, 7 Stone Tower Lane, Barrington, R.I. 02806; Willard B. Goodman, P.O. Box 62, Newport, Oreg. 97365

[21] Appl. No.: 734,319

[22] Filed: Oct. 20, 1976

[51] Int. Cl.[2] ..... E02D 7/30

[52] U.S. Cl. ..... 61/53.72; 242/72 B

[58] Field of Search ..... 61/53.72, 63; 242/72 B

[56] References Cited

U.S. PATENT DOCUMENTS

| | | | |
|---|---|---|---|
| 3,005,315 | 10/1961 | Cobi | 61/53.72 |
| 3,418,817 | 12/1968 | Rusche | 61/53.72 |
| 3,802,207 | 4/1974 | Guild et al. | 61/53.72 |

*Primary Examiner*—Jacob Shapiro

[57] ABSTRACT

An expansible mandrel operated by fluid pressure has its head end encircled by a fluid supply joint having inner and outer rings, the outer ring supported by the hoist ring of a pile driver and held against turning by the guide rails thereof. The inner ring is supported by the outer ring for rotation independently thereof and is connected to the mandrel to turn therewith. Each ring has a pair of conduits with the corresponding conduits of the two rings in communication. Each of the conduits of the outer ring is connected to a hose extending to the ground and each of the two conduits of the inner ring is connected by a hose to the appropriate one of the conduits that are in communication with the fluid pressure operated means.

12 Claims, 6 Drawing Figures

ROTARY FLUID SUPPLY JOINTS FOR EXPANSIBLE MANDRELS

BACKGROUND REFERENCES

U.S. Pat. No. 3,625,013
U.S. Pat. No. 3,779,026
U.S. Pat. No. 3,802,207
U.S. Pat. No. 3,803,854
U.S. Ser. No. 695,259, filed June 11, 1976
U.S. Ser. No. 725,952, filed Sept. 23, 1976

BACKGROUND OF THE INVENTION

Expansible mandrels that are operated by fluid pressure have their fluid pressure operated means adjacent their head ends, usually within the mandrels but, as disclosed in copending application, Ser. No. 695,259, fluid pressure operated means may be externally of the mandrels. The fluid may be air or oil.

The control of the fluid pressure operated means requires long hoses extending from a fluid pressure source on the ground to the head end of the mandrel where they are detachably secured to fittings to enable the fluid pressure operated means to be operated to effect the pile-entering or the pile-gripping relationship of the mandrel sections.

Such mandrels enable tubular piles and like thin walled members to be effectively and efficiently driven. In use, a mandrel is secured to a drive head in a manner enabling the mandrel to turn relative thereto and this leads to a problem if, in driving a tubular pile, that pile should turn. The most commonly used tubular pile is a corrugated shell with the corrugations spirally disposed. As a consequence, the driving of such piles is attended by the continual turning of the pile and the mandrel. As a result, the hoses become so wound about the pile that it is necessary to interrupt the driving operation and either disconnect the hoses, untangle them and then reconnect them to their fittings or to free the mandrel from the partially driven pile to an extent enabling it to be manually turned to unwind the hoses, in either case, a substantial loss in driving time resulting.

THE PRESENT INVENTION

The general objective of the present invention is to provide means that prevent the hose lines to and from the fluid pressure operated means of expansible mandrels from becoming wound about a pile as it is being driven. The invention includes a rotary fluid supply joint interconnecting upper and lower sections of the hose lines, and such a joint together with a mandrel.

An expansible mandrel includes sections joined by a head attachable to the hoist ring of a pile driver in a manner permitting the mandrel to turn but the hoist ring is slidable along vertically disposed guide rails and is thus held from turning. The mandrel sections are forced from their pile-entering relationship into their pile-gripping relationship by means under the control of a fluid pressure operated unit with conduits by which the fluid under pressure is delivered to such a unit and relieved therefrom, in the case where the unit is operated by air under pressure, or the liquid delivered from or returned to source, in the case the unit is hydraulically operated. Such conduits include external hose lines extending from the ground to the head end of the mandrel.

In accordance with the invention, a rotary joint includes inner and outer rings, the outer ring attachable to the pile driver to be held against rotation and the inner ring supported by the outer ring but free to turn relative thereto and the inner ring connectable to the mandrel to turn therewith.

Each ring has two vertically spaced conduit portions and the corresponding conduit portions of the two rings are in communication with each other in any position of the inner ring as it turns relative to the outer ring. Each hose line includes two sections, a short upper section and a long lower section. Each conduit portion of the outer ring has a port to which an appropriate one of the longer hose sections is attached and each conduit portion of the inner ring has a port to which an appropriate one of the shorter hose sections is attached.

Another objective of the invention is to provide a simple means by which the outer ring can be attached to the pile driver, an objective attained by providing the outer ring with shoes engageable with the guide rails thereof and with the outer ring and the hoist ring having means enabling them to be interconnected as by a lashing.

Another objective of the invention is concerned with the provision of simple means by which the inner ring is caused to turn with the mandrel, an objective attained by providing the upper end of the mandrel with diametrically disposed ribs extending lengthwise of its head end and the inner ring with diametrically opposed pairs of ribs, each rib pair to receive a mandrel rib between them enabling the mandrel to be attached conventionally to a drive head with the assurance that the inner ring will turn with the mandrel.

Yet another objective of the invention is to provide joint conduits that meet manufacturing and use requirements, an objective attained with the conduit portions of one ring, preferably the inner ring, vertically spaced annular channels, closed by the other ring, the conduits of which have radial ports, one for each channel and opening therein. Both rings include vertical bores the lower ends of which are the ports to which the hose sections are detachably attached.

BRIEF DESCRIPTION OF THE DRAWINGS

In the accompanying drawings, a preferred embodiment of the invention is illustrated

THE PREFERRED EMBODIMENT OF THE INVENTION

Figure 1:
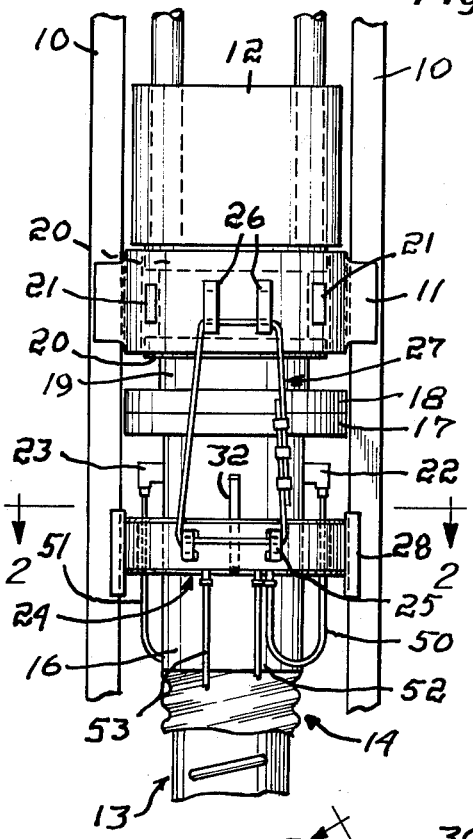
FIG. 1 is a fragmentary, side elevation of a pile, expansible mandrel and pile driver showing a rotary fluid supply joint for the mandrel.

As shown in FIG. 1, a conventional pile driver has vertically disposed guide rails 10 to which the hoist ring 11 for for the hammer 12 is slidably connected. An expansible mandrel is generally indicated at 13 and the shell or tubular pile locked thereto is generally indicated at 14 and shown as of the type having spirally disposed corrugations. Such mandrels include sections 15, see FIG. 2, that may be forced apart from a pileentering relationship into a pile-gripping relationship and the upper end of each section is provided with a reinforcement or doubler 16 and a flange 17. The flanges 17 are connected to the bottom flange 18 of a drive head 19 typically having flanges 20 providing an annular space for removable locking wedges 21. Such a connection, while secure, does not prevent the mandrel 13 from turning relative to the hoist ring 11. The expansible mandrel 13 is of the type including means operated by fluid under pressure to effect the expanded, pile-gripping relationship of its sections, and it may also have fluid pressure operated means to return the mandrel sections into their pile-entering relationship. Such means are not shown as, apart from the external hose lines, the means by which the mandrel sections are forced into their pile-gripping relationship forms no part of the present invention. Reference is made to the following patents for preferred constructions of such means with such means shown as piston-cylinder units within the mandrels: U.S. Pat. No. 3,625,013, 3,779,026, 3,802,207, and 3,803,854; and to U.S. application Ser. No. 695,259 where such means are or may be mounted externally of the mandrel. In the disclosed embodiment of the invention, fluid pressure operated means are provided to effect the pile-gripping relationship of the mandrel sections only and are wholly within the mandrel and are operated by oil under pressure. Fittings 22 and 23 are shown in FIG. 1 at the upper end of the mandrel 13 and these are at the outer end of conduits having internal connections, not shown, with the fluid pressure operated means.

As the pump controlled unit, not shown, for supplying oil under pressure to the fluid pressure operated means is located on the ground, the hose lines through which is circulated the oil to control fluid pressure operated means are necessarily long. As stated, during the pile-driving operation, the pile and mandrel turn with the result that the flexible hose lines become wrapped around the pile requiring that the driving operation be halted until the lines can be straightened out, either by disconnecting them from the mandrel or by freeing the mandrel to enable it to be manually turned until the hose lines are straightened.

In accordance with the invention, a rotary fluid supply joint, generally indicated at 24 is provided to prevent the hose lines from thus interfering with driving operations. The rotary joint includes inner and outer, mandrel-surrounding rings 24A and 24B, the rings 24A provided with diametrically opposed pairs of eyes 25 and the hoist ring 11 provided with eyes 26 enabling the ring 24A to be held vertically in position by lashings 27. The outer ring 24A also includes shoes 28 between which the eyes 25 are located, the shoes 28 slidably fitting the guide rails 10 of the pile driver thereby to hold the ring 24A against turning. The outer ring 24A has retaining rings 29 bolted to its upper and lower surfaces and confining and supporting the inner ring 24B which has diametrically opposed pairs of closely spaced, vertical ribs 30 and 31 exposed inwardly of the retaining rings 29. The doubler 16 of each mandrel section is provided with a pair of diametrically opposed ribs 32, one for each mandrel section 15 and each loosely confined between a pair of the ribs 30 and 31 of the inner ring 24B and of substantially greater length.

The mandrel 13 may be conventionally secured to the drive head 19 and the rotary joint 24 then raised and lashed to the hoist ring 11 with the spaced pairs of ribs 30, 31 receiving the ribs 32 of the mandrel between them with the length of ribs 32 making it unnecessary to locate the joint 24 in a precise position relative to the hoist ring.

The proximate faces of the rings 24A and 24B are cylindrical and a machine fit with the outer face of the inner section 24B provided with vertically spaced series of annular channels including oil channels 33 and 34, each between a pair of channels 35 which are provided with sealing rings 36.

As the inner section 24B is simply confined between the keepers or retaining rings 29, the retaining rings 29 are provided with channels 37 for seals 38 which act as barriers against the entry of dirt.

Between each pair of eyes 25, the outer section 24A has a boss 39 exposed externally of the retaining rings 29 and one boss 39 has vertical bores 40 and 41 with a transverse bore 42 placing the bore 40 in communication with the oil channel 33 and a transverse bore 43 placing the bore 41 in communication with the oil channel 34. The lower end of each bore 40, 41 is threaded to receive a fitting 44.

One of the ribs 31 of the inner ring 24B has a vertical bore 45 placed in communication with one oil ring by a transverse bore 46 and the other rib 31 has a vertical bore 47 placed in communication with the other oil ring by a transverse bore 48. The lower ends of the bores 45 and 47 have fittings 49.

Figure 3:
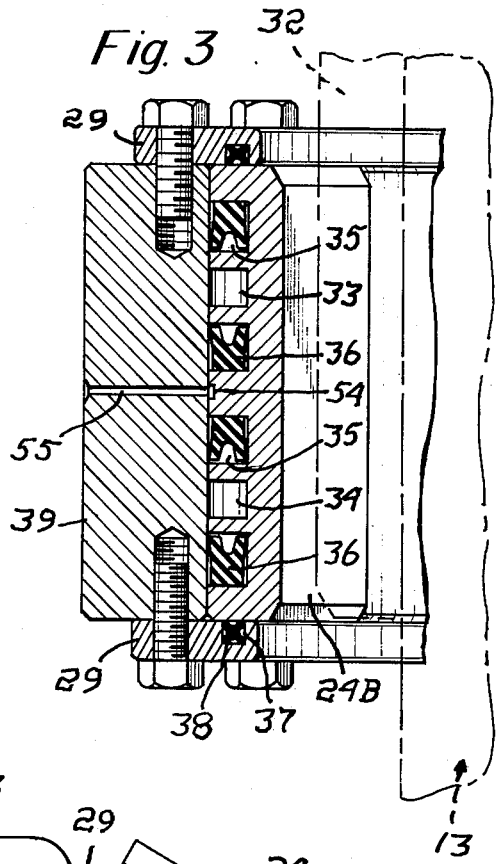
FIG. 3 is a section taken along the indicated line 3—3 of FIG. 2.

With the mandrel 13 secured to the drive head 27 and the joint 24 lashed to the hoist ring 11, a relatively short length of hose 51 is connected to the fittings 22 of the mandrel 13 and to the appropriate one of the fittings 49 of the inner ring 24B and a like length of hose 52 is connected to the fitting 23 and the other fitting 49. Each of the relatively long hoses 52 and 53 from the pump controlled unit on the ground is connected to the appropriate one of the fittings 44 of the outer ring 24A with the assurance that the driving operation will not be interrupted by the hoses becoming wound about the mandrel since the outer ring 24A cannot turn. The inner ring 24B has, see FIG. 3, an annular groove 54 for a lubricant introduced through the bore 55 in the outer ring 24A.

Figure 2:
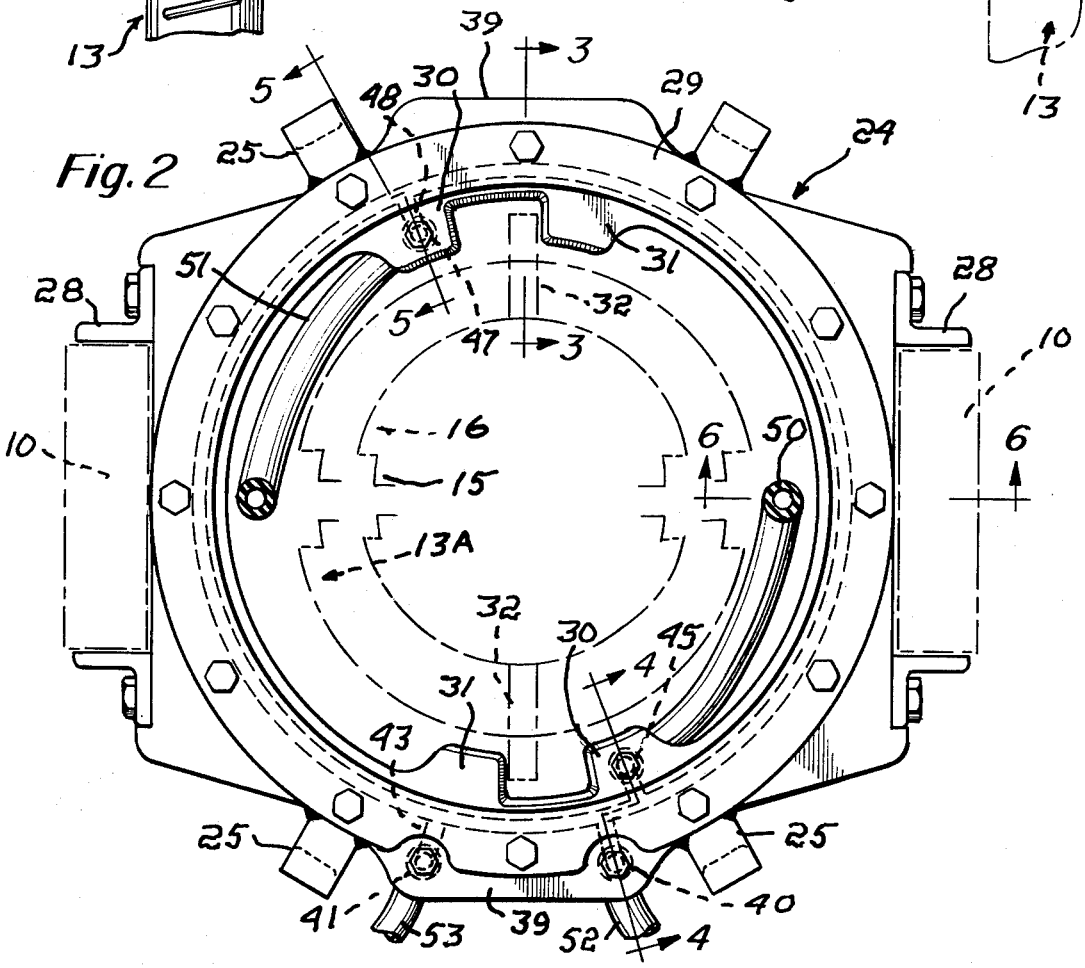
FIG. 2 is a section, on a substantial increase in scale, taken approximately along the indicated line 2—2 of FIG. 1 but with the mandrel and guide rails shown only in phantom.
Figure 4:
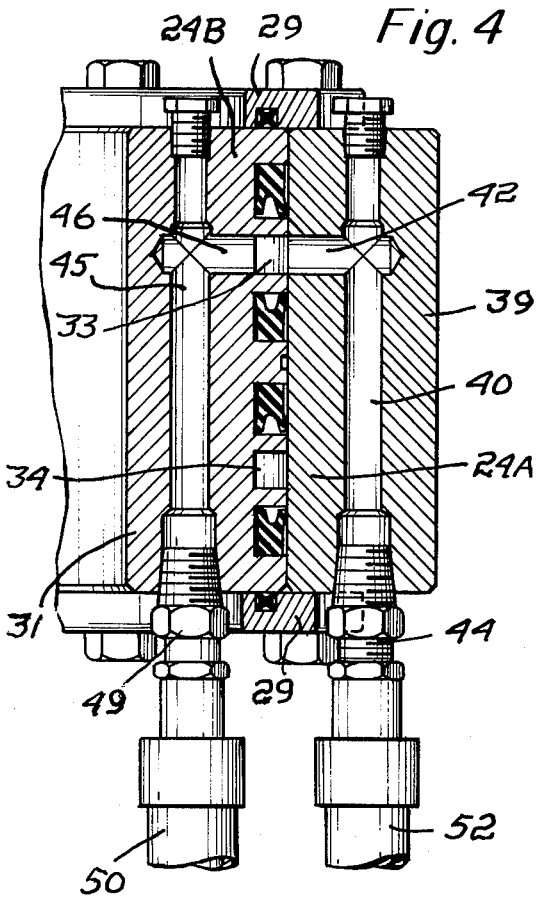
FIG. 4 is a section taken approximately along the indicated line 4—4 of FIG. 2.
Figure 5:
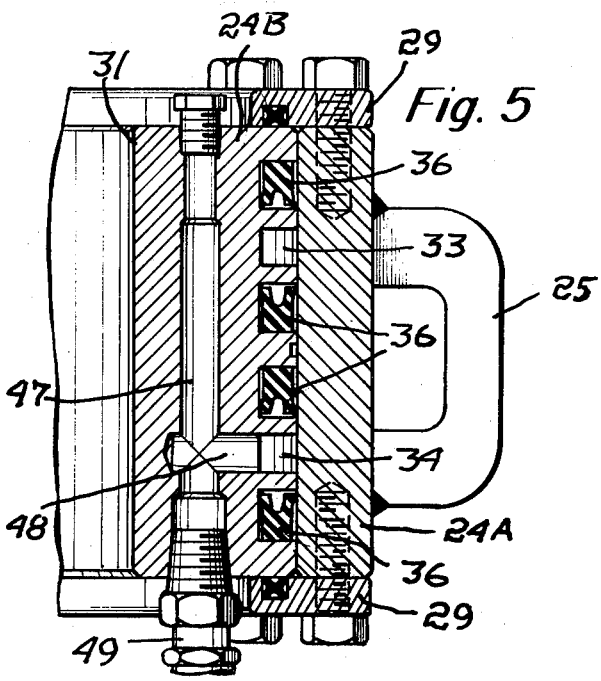
FIG. 5 is a section taken approximately along the indicated line 5—5 of FIG. 2.
Figure 6:
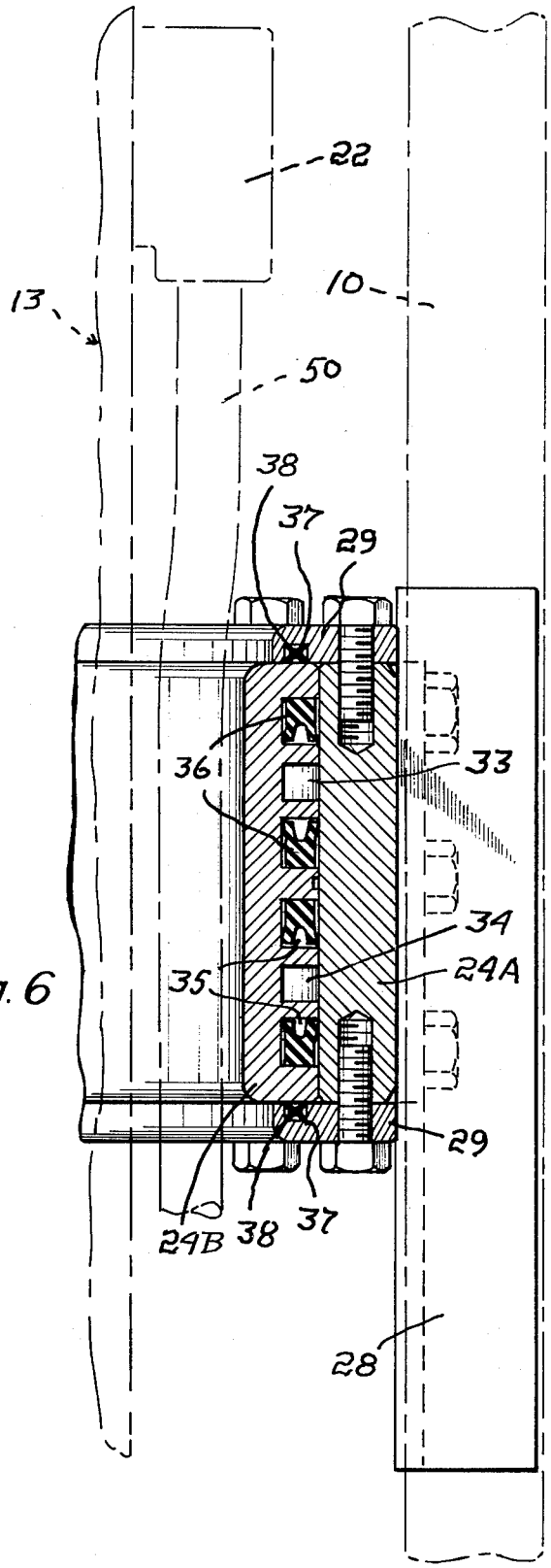
FIG. 6 is a section taken along the indicated line 6—6 of FIG. 2 with parts of the pile driver also shown in phantom.

It will be noted from FIG. 2 that the rotary joint 24 can be used with mandrels of different diameters. For example, a larger mandrel 13A may be connected to the inner ring if provided with ribs of appropriately lesser radial extent.

We claim:

1. A rotary fluid supply joint to encircle an expansible mandrel below but adjacent the head thereof, the mandrel to be driven by a pile driver having a hoist ring slidable along vertical guide rails, the mandrel of the type having fluid pressure operated means by which the mandrel is expanded from a pile-entering condition into a pile-gripping condition, and conduits in communication therewith, each conduit having a relatively short upper hose section at the upper end of the mandrel and a relatively long lower hose section, both sections externally of the mandrel and the lower section extending to the ground, said joint including inner and outer rings, the inner ring free to turn within the outer ring, said outer ring including shoes for sliding engagement with said rails and means by which it may be attached to and supported by said hoist ring, said inner ring including means by which it may be connected to the mandrel to turn therewith, each ring including two vertically spaced conduit portions, corresponding conduit portions of the two rings in communication with each other as the inner ring turns, each conduit portion of the outer ring having a port to which an appropriate one of the longer hose sections is connectable and each conduit portion of the inner ring having a port to which an appropriate one of the shorter hose sections is connectable.

2. The rotary fluid supply joint of claim 1 in which the inner ring has diametrically opposed vertical pairs of ribs as the means by which it may be connected to the mandrel.

3. The rotary fluid supply joint of claim 2 in which the ports of the inner ring conduit portions are located in said ribs.

4. The rotary fluid supply joint of claim 1 in which the outer ring includes vertically spaced retaining rings supporting and confining the inner ring against vertical movement but permitting said inner ring to turn.

5. The rotary fluid supply joint of claim 4 in which the outer ring includes a projection exposed externally of the retaining rings in which the ports of the outer ring conduit portions are located.

6. The rotary fluid supply joint of claim 4 in which the inner ring includes diametrically opposed pairs of ribs projecting inwardly relative to the retaining rings in which the ports of the inner ring conduit portions are located and the outer ring includes a projection extending outwardly relative to the retaining rings in which the ports of the outer ring conduit portions are located.

7. The rotary fluid supply joint of claim 6 in which each conduit portion of one of said rings includes an annular channel and a radial section placing the port in communication therewith and each conduit portion of the other ring includes a radial section opening into the appropriate one of said rings.

8. The rotary fluid supply joint of claim 6 in which the ring having the annular channels is the inner ring.

9. The rotary fluid supply joint of claim 6 in which the outer ring includes diametrically opposed pairs of eyes for a lashing by which the joint is to be secured to the hoist ring and the ports of the rings are located between the eyes of each pair.

10. An expansible mandrel and a rotary fluid supply joint for use with a pile driver having a hoist ring slidable along vertical guide rails, said mandrel including a pair of lengthwise sections, a head joining said sections and attachable to said hoist ring in a manner permitting the mandrel to turn, fluid pressure operated means operable to expand said mandrel sections from a pile-entering relationship into a pile-gripping relationship, and conduits in communication therewith, each conduit having a relatively short hose section at the upper end of the mandrel and a relatively long lower hose section, both hose sections externally of the mandrel and the lower hose sections extending to the ground, said joint including inner and outer rings, the outer ring attachable to said hoist ring and provided with shoes for sliding engagement with the guide rails and rotatably supporting the inner ring, said inner ring and the upper end of said mandrel including portions connecting them to turn together, each ring including two vertically spaced conduit portions, corresponding portions of the two rings in communication with each other throughout the turning of the inner ring, each conduit portion of the outer ring having a port with which an appropriate one of the longer hose sections is in communication and each conduit portion of the inner ring having a port with which an appropriate one of the shorter hose sections is in communication.

11. The expansible mandrel of claim 10 in which the portions by which the inner ring and the mandrel are connected are diametrically opposed sets of ribs extending lengthwise thereof, each set includes two spaced inner ring ribs internally and an intermediate mandrel rib externally of the mandrel, the two ribs of each set so spaced that the intermediate mandrel rib is loosely confined therebetween.

12. The expansible mandrel of claim 11 in which the ribs of the mandrel are substantially longer than the ribs of the inner ring.

* * * * *